US010816168B2

(12) United States Patent
Zeman

(10) Patent No.: US 10,816,168 B2
(45) Date of Patent: Oct. 27, 2020

(54) OUTDOOR LIGHT ASSEMBLY

(71) Applicant: Hunter Industries, Inc., San Marcos, CA (US)

(72) Inventor: Adam Zeman, Del Mar, CA (US)

(73) Assignee: Hunter Industries, Inc., San Marcos, CA (US)

( * ) Notice: Subject to any disclaimer, the term of this patent is extended or adjusted under 35 U.S.C. 154(b) by 66 days.

(21) Appl. No.: 16/190,097

(22) Filed: Nov. 13, 2018

(65) Prior Publication Data

US 2020/0149715 A1 May 14, 2020

(51) Int. Cl.

| | |
|---|---|
| ***F21V 21/04*** | (2006.01) |
| ***F21V 23/00*** | (2015.01) |
| ***F21S 8/02*** | (2006.01) |
| ***F21V 19/00*** | (2006.01) |
| ***F21V 15/01*** | (2006.01) |
| *F21Y 115/10* | (2016.01) |
| *F21W 131/109* | (2006.01) |

(52) U.S. Cl.

CPC ..... *F21V 21/04* (2013.01); *F21S 8/022* (2013.01); *F21V 15/01* (2013.01); *F21V 19/0015* (2013.01); *F21V 23/001* (2013.01); *F21W 2131/109* (2013.01); *F21Y 2115/10* (2016.08)

(58) Field of Classification Search

CPC ..... F21V 21/04; F21V 15/01; F21V 19/0015; F21V 23/001; F21S 8/022; F21Y 2115/10; F21W 2131/109

USPC ..... 362/296.01

See application file for complete search history.

(56) References Cited

U.S. PATENT DOCUMENTS

2006/0114680 A1* 6/2006 Miller ..... F21S 8/08 362/370

2017/0219188 A1* 8/2017 Veloskey ..... F21V 23/003

OTHER PUBLICATIONS

Vista Professional Outdoor Lighting Installation Instructions for the 4260 Landscape Series Step & Brick Lights; downloaded Nov. 12, 2018.

* cited by examiner

*Primary Examiner* — Cara E Rakowski
*Assistant Examiner* — Hana S Featherly
(74) *Attorney, Agent, or Firm* — Knobbe Martens Olson & Bear, LLP

(57) ABSTRACT

Disclosed is an outdoor light assembly to be disposed in a pathway or other hardscape area. The light assembly having a sleeve forming a receptacle having one or more coupling structures disposed in the receptacle and a user replaceable light fixture assembly being sized and shaped to transition between a secured position and an unsecured position relative to the receptacle. The light fixture assembly having one or more engagement structures that are complementary to the one or more coupling structures so as to inhibit, but not prevent, removal of the light fixture assembly from the sleeve when the light fixture assembly is in the secured position.

22 Claims, 11 Drawing Sheets

OUTDOOR LIGHT ASSEMBLY

BACKGROUND

Field

This invention relates to lights, and more particularly, relates to outdoor light fixture assemblies.

Description of the Related Art

Outdoor lighting is frequently used in gardens, yards, landscapes, walkways, steps, and building exteriors to provide visibility, security, and/or aesthetics. Common types of outdoor light fixtures include path lights, wall lights, tree lights, deck lights, well lights, step lights, paver lights, and rope lights.

SUMMARY

In a first aspect, an outdoor light assembly configured to be disposed in a pathway or other hardscape area. The light assembly comprises a sleeve forming a receptacle having one or more coupling structures disposed in the receptacle and a user replaceable light fixture assembly being sized and shaped to transition between a secured position and an unsecured position relative to the receptacle. The light fixture assembly has one or more engagement structures and a power transfer element. The one or more engagement structures are disposed so as to engage with the one or more coupling structures of the sleeve when the light fixture assembly is pressed into the secured position and disengage from the one or more coupling structures when the light fixture assembly is lifted from the secured position to the unsecured position. The power transfer element is configured to electrically connect with a source of electric power through the sleeve at least when the light fixture assembly is in the unsecured position.

In a second aspect, an outdoor light assembly is provided. The outdoor light fixture assembly is configured to be disposed in a pathway or other hardscape area. The light assembly comprises a sleeve forming a receptacle having one or more coupling structures disposed in the receptacle and a user replaceable light fixture assembly being sized and shaped to transition between a secured position and an unsecured position relative to the receptacle. The light fixture assembly has one or more engagement structures that are complementary to the one or more coupling structures so as to inhibit, but not prevent, removal of the light fixture assembly from the sleeve when the light fixture assembly is in the secured position.

In a third aspect, a method of installing a paver light in a pathway or other hardscape made of a plurality of pavers is provided. The method comprises setting the plurality of pavers and a dummy light in place to form the pathway. The dummy light comprises a sleeve covered by an installation plate. The sleeve forms a receptacle having one or more coupling structures disposed in the receptacle. The installation plate is shaped to be disposed in a receptacle in the sleeve. The method further comprises spreading sand over the pathway, vibrating the sand to fall between the plurality of pavers and the dummy light, prying the installations plate near the notch to remove the installation plate from the sleeve, and electrically connecting a light fixture assembly to a source of power coming through the sleeve. The light fixture assembly has one or more engagement structures that are complementary to the one or more coupling structures.

The method further comprises pushing the light fixture assembly into the sleeve so that the one or more engagement structures engage with the one or more coupling structures to inhibit, but not prevent, removal of the light fixture assembly from the sleeve.

In a fourth aspect, a method of servicing a paver light in a pathway made of a plurality of pavers or other hardscape is provided. The method comprises removing a first light fixture assembly from a sleeve by prying on a portion of the first light fixture assembly to lift it away from one or more complementary coupling structures of the sleeve and removing the first light fixture assembly from the sleeve but not removing the sleeve from the hardscape, electrically disconnecting the first light fixture assembly from a source of power coming through the sleeve, electrically connecting a second light fixture assembly to the source of power coming through the sleeve, the second light fixture assembly having one or more engagement structures that are complementary to the one or more complementary coupling structures, and pushing the second light fixture assembly into the sleeve so that the one or more engagement structures engage with the one or more complementary coupling structures to inhibit, but not prevent, removal of the second light fixture assembly from the sleeve.

BRIEF DESCRIPTION OF THE DRAWINGS

The features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will now be described with additional specificity and detail through use of the accompanying drawings.

DETAILED DESCRIPTION

The following detailed description is directed to certain specific embodiments. The invention(s) disclosed herein, however, can be embodied in a multitude of different ways as defined and covered by the claims. In this description, reference is made to the drawings, wherein like parts are designated with like numerals throughout. The features, aspects and advantages of the present invention will now be described with reference to the drawings of several embodiments that are intended to be within the scope of the development herein disclosed. These and other embodiments will become readily apparent to those skilled in the art from the following detailed description of the embodiments having reference to the attached figures, the invention not being limited to any particular embodiment(s) herein disclosed.

Paver lights are known and commonly mount in a hardscaped portion of a landscaped area. In the case of a pathway or other hardscape area constructed of pavers placed against one another, a paver light can be sized and shaped to directly replace one or more pavers. Many known paver lights are constructed such that replacement of the paver light requires the entire light assembly to be removed from the hardscape. This typically requires removal of several pavers in the adjacent area of the paver light. Thus, to replace the paver light, the adjacent pavers are also removed and then reinstalled with the new paver light. As part of the final installation, the new paver light and the reinstalled adjacent pavers are leveled to match the surrounding area.

Figure 1:
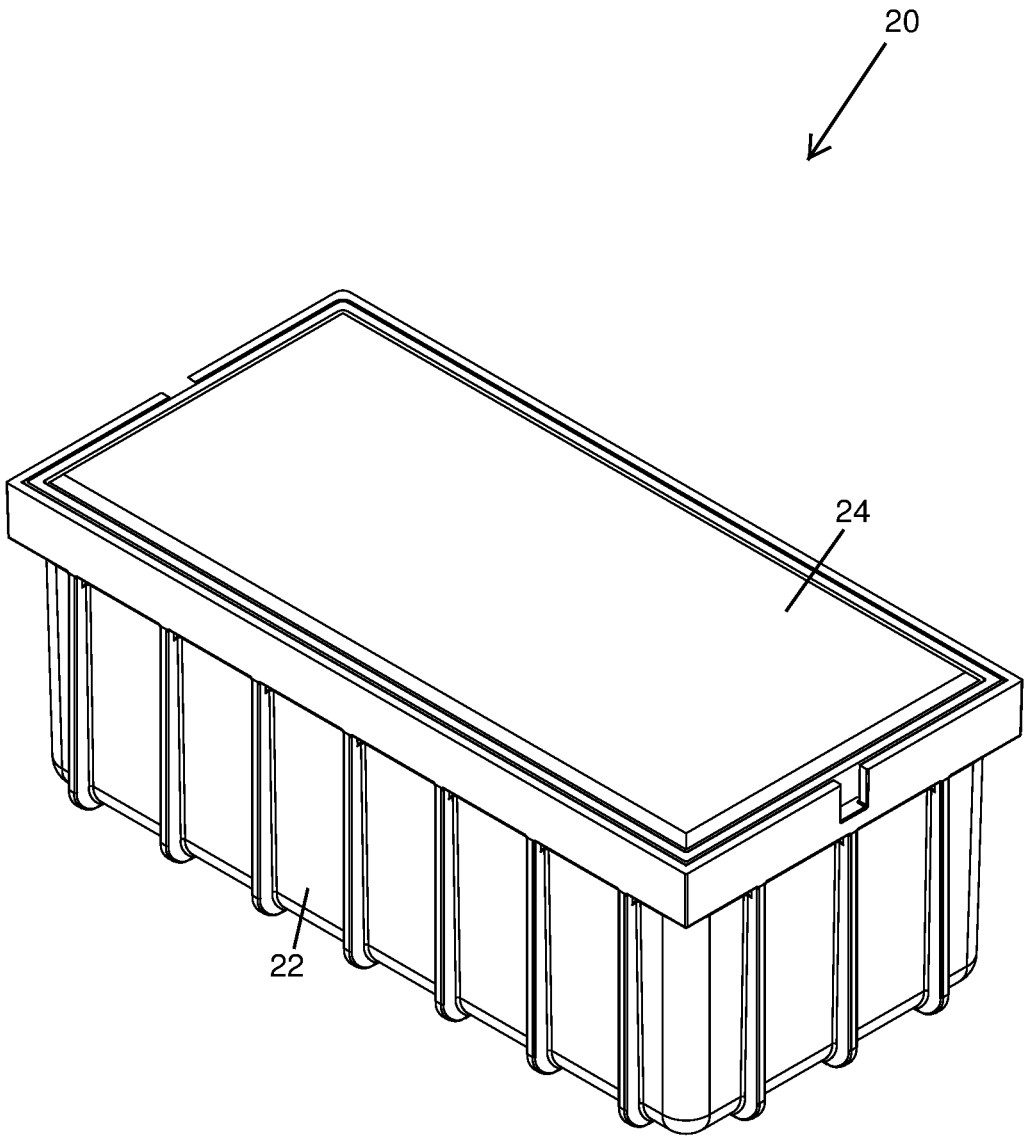
FIG. 1 is a perspective view of a light assembly according to a preferred embodiment of the present invention.

FIG. 1 illustrates an embodiment of a light assembly 20 in the form of a paver light. The light assembly 20 can be secured within a pathway or other hardscape area constructed of pavers to emit light towards a desired area, direction, or surface. In certain embodiments, the light assembly 20 can include a sleeve 22 and a light fixture assembly 24. In certain embodiments, the light fixture assembly 24 can be supported by the sleeve 22. An advantage of the structure of the light assembly 20 illustrated in FIG. 1 is the structure allows a user to first install the sleeve 22 in the hardscape without the light fixture assembly 24. Once the sleeve 22 is installed in the hardscape, the user can then install and/or remove the light fixture assembly 24 from the sleeve 22 without disturbing the hardscape.

The light fixture assembly 24 can be configured to emit light in one or more directions exterior to the light fixture assembly 24. In certain embodiments, the preferred direction is substantially upwards.

Figure 2:
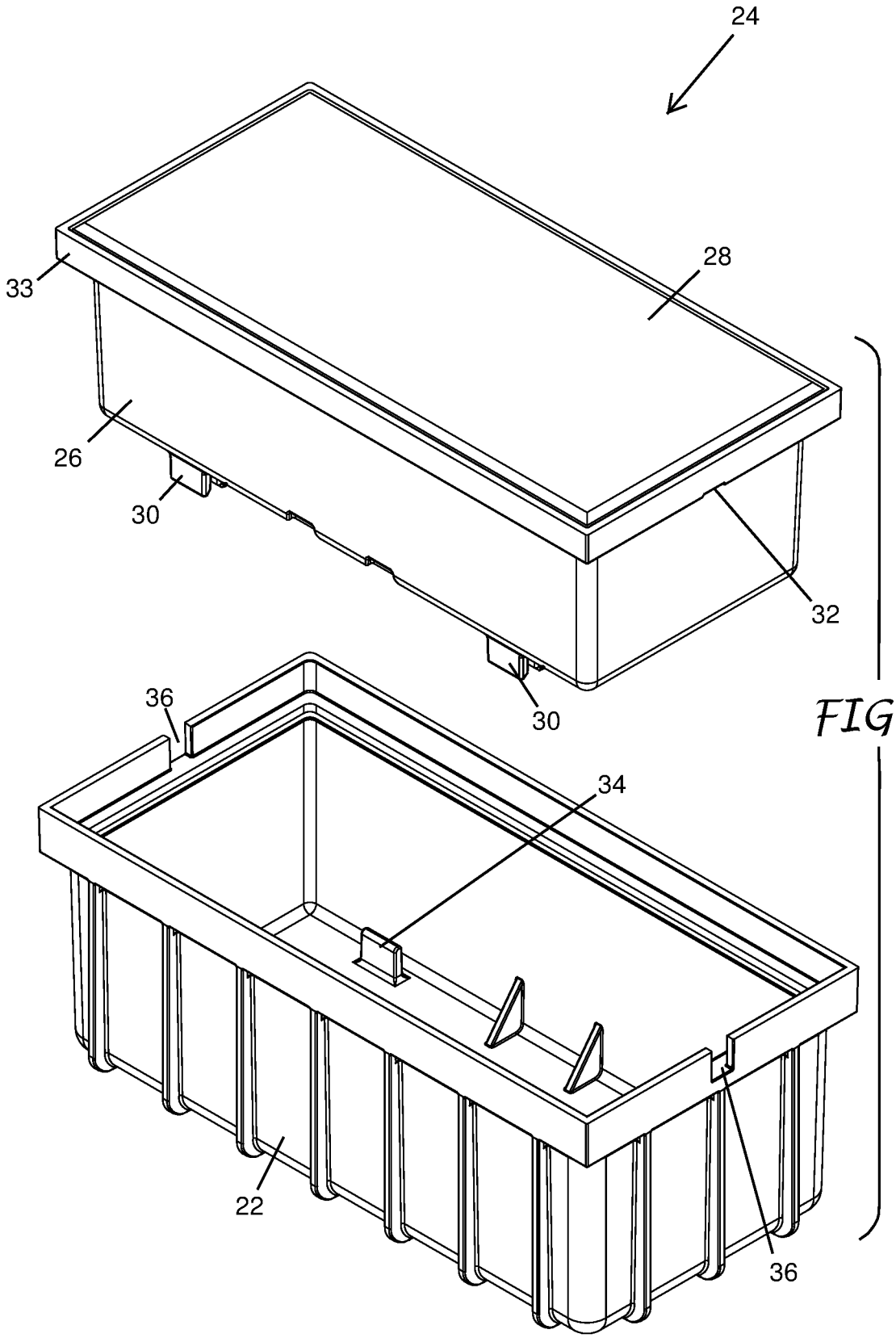
FIG. 2 is an exploded perspective view of the light assembly of FIG. 1 showing a light fixture assembly removed from a sleeve.

FIG. 2 is an exploded perspective view of the light assembly 20 of FIG. 1 showing the light fixture assembly 24 removed from a receptacle of the sleeve 22. In certain embodiments, the light fixture assembly 24 can include a housing 26 and a lens 28. In certain embodiments, the light fixture assembly 24 can be releasably secured within the sleeve 22. In certain embodiments, the light fixture assembly 24 is installed as a sealed unit into the sleeve 22. In certain other embodiments, the light fixture assembly 24 is user serviceable by allowing a user to service individual components of the light fixture assembly 24. In certain embodiments, the light fixture assembly 24 can be configured to emit light in one or more directions exterior to the housing 26.

In certain embodiments, the housing 26 can be formed of one or more plastics such as a molded plastic. In certain embodiments, the housing 26 can be formed of one or more metals. In certain embodiments, the housing 26 can be created with a 3D printer. In certain embodiments, the housing 26 can be formed of cast aluminum. In certain embodiments, the housing 26 can be formed of cast brass. In certain embodiments, the housing 26 can be formed of a heat conductive plastic or composite.

The light fixture assembly 24 can be releasably coupled to the sleeve 22 at one or more locations. In certain embodiments, the light fixture assembly 24 includes one or more engagement structures 30 disposed so as to engage with one or more coupling structures 34 of the sleeve 22 when the light fixture assembly 24 is disposed within at least a portion of the sleeve 22. In certain embodiments, the one or more engagement structures 30 are complementary to the one or more coupling structures 34 so as to inhibit, but not prevent, removal of the housing 26 from the sleeve 22 when the light fixture assembly 24 is disposed within at least a portion of the sleeve 22.

In certain embodiments, the one or more engagement structures 30 of the housing 26 are configured in a shape of legs while the one or more coupling structures 34 of the sleeve 22 are configured in a shape of a complementary tab. In this way, the one or more engagement structures 30 press fit over the one or more coupling structures 34 when the light fixture assembly 24 is disposed within the sleeve 22. In certain embodiments, the light fixture assembly 24 is releasably secured to the one or more coupling structures 34 of the sleeve 22 via a snap fit or press fit. In certain embodiments, the one or more coupling structures 34 limit movement of the light fixture assembly 24 relative to the sleeve 22 so that the light fixture assembly 24 does not disengage from the sleeve 22 due to pedestrian traffic or other contact with the exposed portion of the light assembly 20 when installed in the hardscape. For example, in certain embodiments, the one or more coupling structures 34 prevent the light fixture assembly 24 from disengaging from the sleeve 22 and presenting a tripping hazard to pedestrian traffic.

Of course the one or more engagement or coupling structures 30, 34 are not limited to the illustrated embodiments. For example, in certain embodiments, the one or more engagement structures 30 of the housing 26 are configured in a shape of the tab while the one or more coupling structures 34 of the sleeve 22 are configured in a shape of legs.

Further, any shape of the one or more engagement structures 30 that is configured to releasably engage with a shape of the one or more coupling structures 34 falls within the scope of this disclosure. For example, the one or more engagement or coupling structures 30, 34 can include hook and loop fasteners, magnets, posts, holes, recesses, snaps, and other structures that are complementary to each other. In some embodiments, at least one of the surfaces of the mating structures can be textured. In some embodiments, at least one of the surfaces of the mating structures can be formed with at least one groove or extruded section to strengthen the connection.

In certain embodiments, the one or more engagement structures 30 are disposed on a lower surface of the housing 26 while the one or more coupling structures 34 are disposed on an interior bottom of the sleeve 22. In certain embodiments, the one or more coupling structures 34 protrude in a direction toward the housing 26 when the housing 26 is being installed in the sleeve 22. In certain embodiments, the one or more engagement structures 30 are disposed on a different surface than the bottom of the housing 26 while the one or more coupling structures 34 are disposed on a different surface than the interior bottom as long as the surfaces are complementary to each other or at least are in proximity to each other when the light fixture assembly 24 is disposed within at least a portion of the sleeve 22. In certain embodiments, the one or more coupling structures 34 protrude in a direction toward the housing 26 when the housing 26 is being installed in the sleeve 22. In some embodiments, at least one recess can be formed in the housing 26 to receive at least one coupling structure 34 protruding from a surface of the sleeve 22. In some embodiments, at least one recess can be formed in the sleeve 22 to receive at least one engagement structure 30 protruding from a surface of the housing 26.

In certain embodiments, the sleeve 22 includes one or more notches 36. The one or more notches 36 can be disposed in the sleeve 22 to allow a user access to a portion of the light fixture assembly 24 when the light fixture assembly 24 is disposed in the sleeve 22. By providing access to the light fixture assembly 24, the user is able to lift up and/or disengage the light fixture assembly 24 from the sleeve 22 without disturbing the sleeve 22. For example, the user may remove and replace a non-functioning light fixture assembly 24 without disturbing the adjacent hardscape. In certain embodiments, the one or more notches 36 allow the user to access a portion of a perimeter of the light fixture assembly 24 through the sleeve 22. In certain embodiments, the notch 36 can be open to the upper surface of the of the sleeve 22 to allow a user to easily clean any debris that may have accumulated in the notch over time when they are removing the light fixture assembly 24. With the access, the user can use a tool, such as a screw driver, to slide under the portion of the light fixture assembly 24 to lift the light fixture assembly 24 up and disengage or separate the one or more engagement structures 30 of the housing 26 from the one or more coupling structures 34 of the sleeve 22. Once disengaged or raised up by the tool, the user can continue to remove the light fixture assembly 24 from the sleeve 22 by hand.

Of course, in certain embodiments, a portion of the light fixture assembly 24 is accessible without the one or more notches 36 in the sleeve 22. For example, the user can insert a tool or other structure in a vertical gap between the light fixture assembly 24 and the sleeve 22 to hook or pinch a portion of the light fixture assembly 24. Of course the gap need not be vertical as long as the gap is accessible by the user when the light fixture 24 is engaged with the sleeve 22.

In certain embodiments, one or more recesses 32 are provided in the light fixture assembly 24. In certain embodiments, the one or more recesses 32 are disposed in a flange 33 of the housing 26. In certain embodiments, the one or more recesses 32 are in register or aligned with the one or more notches 36 in the sleeve 22. In certain embodiments, the user can use a tool, such as a screw driver, to slide through the one or more notches 36 and under the one or more recesses 32 in the light fixture assembly 24 to lift the light fixture assembly 24 up and disengage or separate the one or more engagement structures 30 of the housing 26 from the one or more coupling structures 34 of the sleeve 22. Once disengaged or raised up by the tool, the user can continue to remove the light fixture assembly 24 from the sleeve 22 by hand. In certain embodiments, the recess 33 can be omitted and the user will position the tool under the flange 33 to lift the light fixture assembly 24 up and disengage or separate the one or more engagement structures 30 of the housing 26 from the one or more coupling structures 34 of the sleeve 22.

In certain embodiments, a depression is provided in an accessible surface of the light fixture assembly 24 for a tool or finger to lift the light fixture assembly 24 up and disengage or separate the one or more engagement structures 30 of the housing 26 from the one or more coupling structures 34 of the sleeve 22. For example, the depression can be provided in a top surface of the lens 28.

In certain embodiments, a user adheres a tool to an accessible surface of the light fixture assembly 24 to lift the light fixture assembly 24 up and disengage or separate the one or more engagement structures 30 of the housing 26 from the one or more coupling structures 34 of the sleeve 22. For example, the tool can be adhered to the light fixture assembly 24 via quick drying adhesive or attached via vacuum or negative pressure to the light fixture assembly 24.

In certain embodiments, the lens 28 is bonded to the housing 26. For example, the lens 28 can be bonded to the housing 26 with silicone or another adhesive/sealant. In certain embodiments, the lens 28 is not bonded to the housing 26. For example, the lens 28 can be press fit or snap fit into the housing 26. In certain embodiments, the light fixture assembly 24 comprises a seal configured to form a seal between the lens 28 and the housing 26. In certain embodiments, the seal inhibits or prevents water or moisture ingress past the lens 28 and into the housing 26. In certain embodiments, the seal is an O-ring.

In embodiments where the lens 28 is tightly adhered or bonded to the housing 26, lifting of the lens 28 may also lift the housing 26 and disengage or separate the one or more engagement structures 30 of the housing 26 from the one or more coupling structures 34 of the sleeve 22. In certain other embodiments where the lens 28 is not tightly adhered or bonded to the housing 26, the user first removes the lens 28 from the housing 26 exposing components and surfaces inside the light fixture assembly 24. The user is then able to grip the exposed components or surfaces to disengage or separate the one or more engagement structures 30 of the housing 26 from the one or more coupling structures 34 of the sleeve 22 and remove the remainder of the light fixture assembly 24 from the sleeve 22.

In certain embodiments, the lens 28 can be positioned to allow light from inside the light fixture assembly 24 to project in at least one direction exterior to the light fixture assembly 24. In certain embodiments, the lens 28 may be plastic or glass. In certain embodiments, the lens 28 can be transparent or substantially transparent. In certain embodiments, the lens 28 can be frosted. In certain embodiments, the lens 28 may be tinted with a color. In certain embodiments, the lens 28 may be tinted with a color to change the color temperature of the light emitting from the light fixture assembly 24.

In certain embodiments, the sleeve 22 can be formed of one or more plastics such as a molded plastic. In certain embodiments, the sleeve 22 can be formed of one or more metals. In certain embodiments, the sleeve 22 can be created with a 3D printer. In certain embodiments, the sleeve 22 can be formed of cast aluminum. In certain embodiments, the sleeve 22 can be formed of cast brass. In certain embodiments, the sleeve 22 can include one or more internal structures to add rigidity to the sleeve 22.

Figure 3:
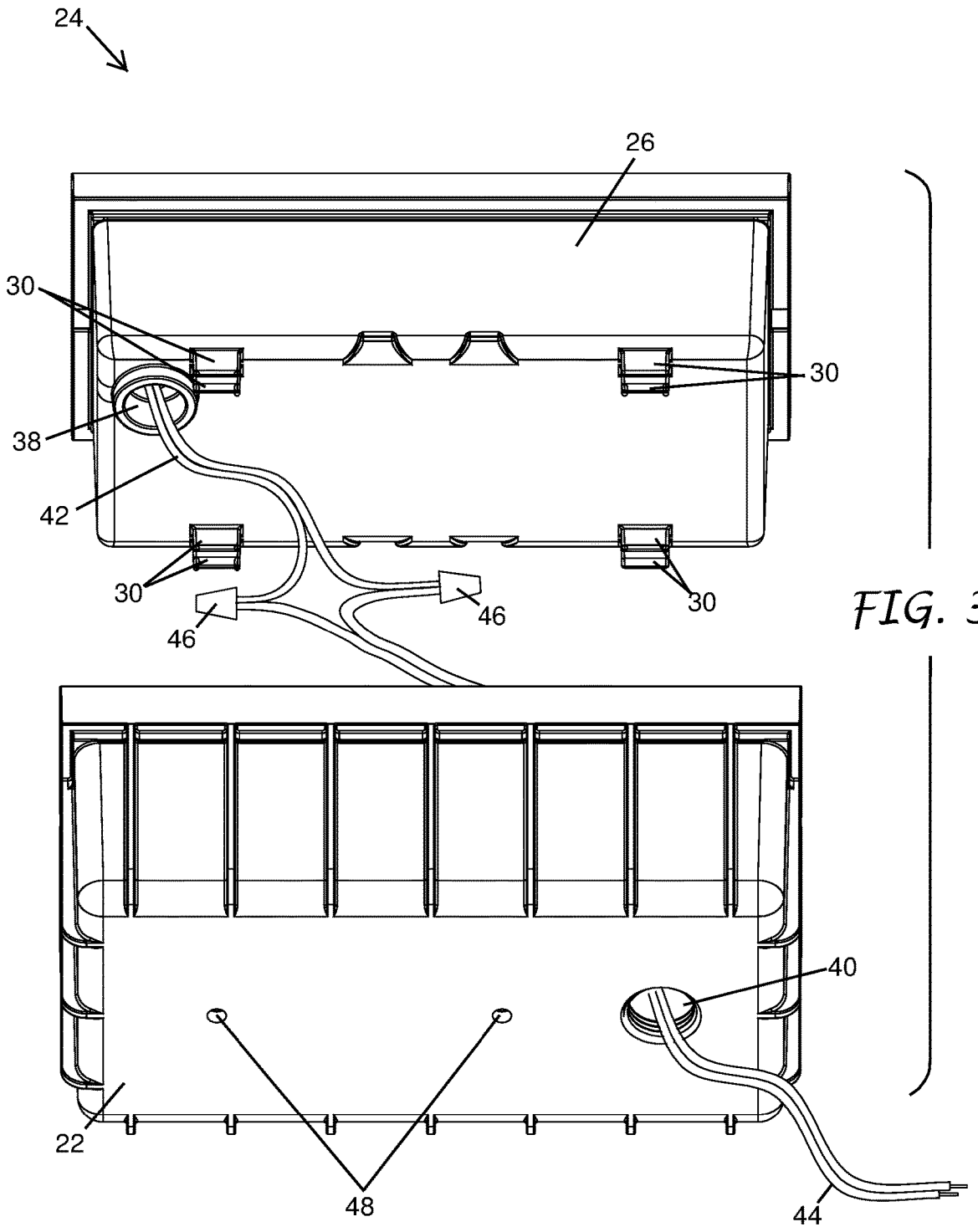
FIG. 3 is an exploded bottom perspective view of the light assembly of FIG. 1 showing exemplary wiring.

FIG. 3 is an exploded bottom perspective view of the light assembly 20 of FIG. 1 showing exemplary wiring. In certain embodiments, the housing 26 comprises a lower opening 38. The lower opening 38 is configured to route a wire 42 through the housing 26. In certain embodiments, the wire 42 is pulled through the lower opening 38 and the lower opening 38 is sealed around the wire 42 during manufacture.

In certain embodiments, the seal comprises a silicone sealant. In this way and in certain embodiments, the wire 42 is a permanent part of the light fixture assembly 24 and is removed from the sleeve 22 along with the light fixture assembly 24. Of course the wire 42 need not be a permanent part of the light fixture assembly 24.

In certain embodiments, the wire 42 is configured to connect to a wire 44 that is connected to a power source or lighting controller. In certain embodiments, the wire 42 connects to the wire 44 via one or more connectors 46. In certain embodiments, the one or more connectors 46 are water proof. In certain embodiments, grease, silicone, or other material can be placed in or around the one or more connectors 46 to make a watertight connection.

In certain embodiments, the sleeve 22 comprises an access hole 40. The access hole 40 is configured to route the wire 44 through the sleeve 22. In certain embodiments, the wire 44 is pulled through the access hole 40.

In certain embodiments, a plurality of wires are bonded or otherwise bound together to form each wire 42, 44. In certain embodiments a plurality of power wires may be bonded together. In certain embodiments, the wires 42, 44 can be an insulated wire having an insulating jacket. In certain embodiments, each of the wires 42, 44 is a plurality of insulated wires with their insulating jackets bonded together. In certain embodiments, the insulated wires are bonded together to form a zip-cord.

In certain embodiments, the access hole 40 receives a fitting. In certain embodiments, the access hole 40 is threaded to facilitate engagement with the fitting. In certain embodiments, the fitting is a cable clamp or other structure. In certain embodiments, the fitting is a conduit for the wire 44. In this way, the conduit can be attached to the sleeve 22.

In certain embodiments, the wire 42 is electrically coupled to the wire 44 and then the light fixture assembly 24 is installed in the sleeve 22. In certain embodiments, the housing 26 is sized and shaped relative to a size and shape of the sleeve 22 to provide a clearance or a gap between the housing 26 and the sleeve 22 for at least a portion of one or more of the wire 42, the wire 44, and the one or more connectors 46. In certain embodiments, excess portions of the wires 42, 44 and the connectors 46 are disposed in the clearance or the gap.

In certain embodiments, the sleeve 22 includes one or more drain holes 48. In certain embodiments, the one or more drain holes 48 allow water that may get between the sleeve 22 and the light fixture assembly 24 to drain out of the sleeve 22 and into the hardscape. For example, the water exiting the drain holes 48 can flow into a sand base supporting the sleeve 22.

Figure 4:
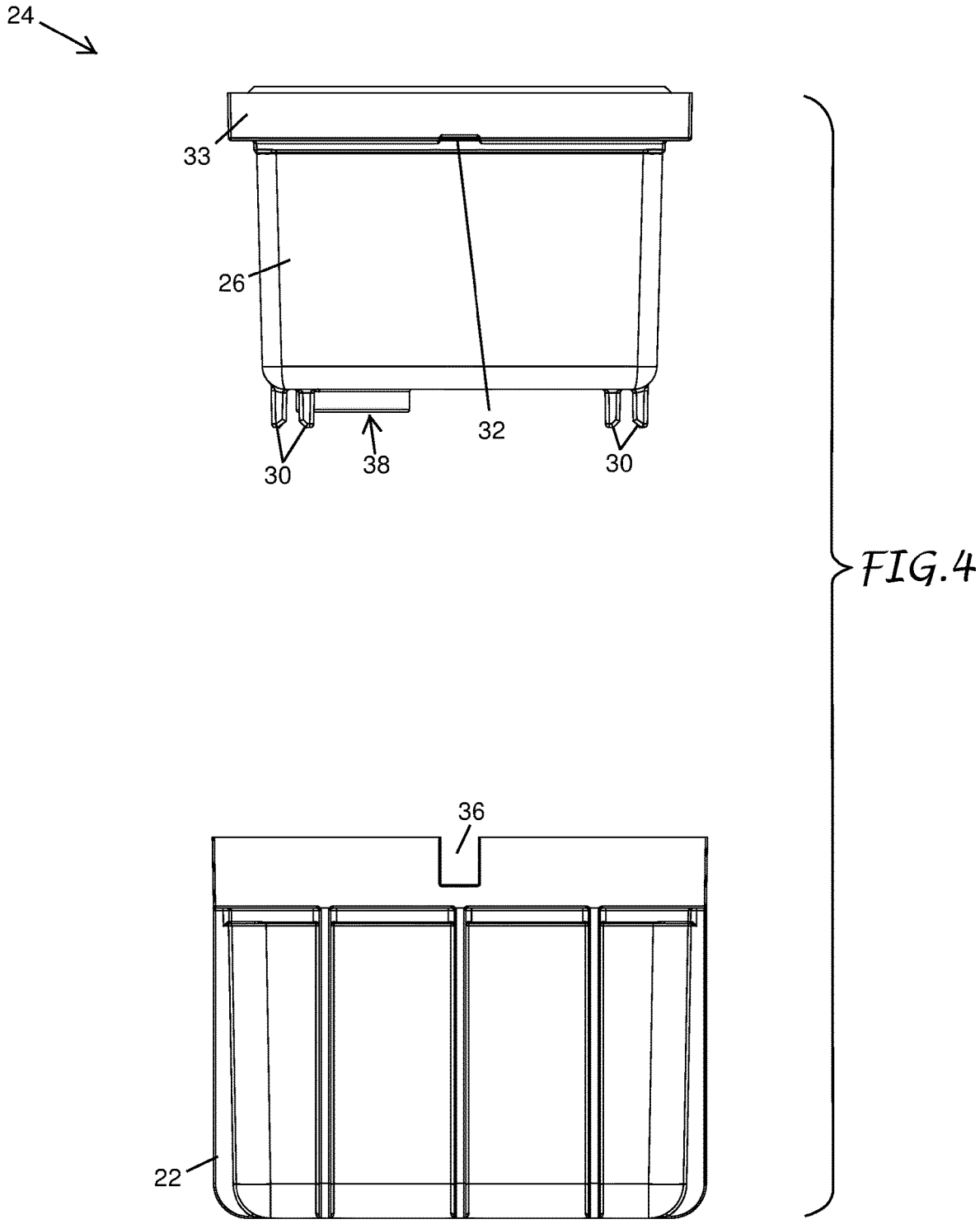
FIG. 4 is an exploded end view of the light assembly of FIG. 1.

FIG. 4 is an exploded end view of the light assembly 20 of FIG. 1. As is illustrated in FIG. 4 and in certain embodiments, the one or more engagement structures 30 of the light fixture assembly 24 are disposed on a bottom of the housing 26. In certain embodiments, the one or more engagement structures 30 are press fit over the one or more coupling structures 34 in the sleeve 22. As is also illustrated in FIG. 4 and in certain embodiments, the one or more recesses 32 of the light fixture assembly 24 are in register or vertically aligned with the one or more notches 36 in the sleeve 22. When assembled and in certain embodiments, at least a portion of the one or more recesses 32 is horizontally aligned with at least a portion of the one or more notches 36 so as to provide a path for the user to insert a tool or finger under a portion of the light fixture assembly 24. Once the tool or finger is inserted, the user can lift the light fixture assembly 24 out of the sleeve 22. In certain embodiments, the tool is a screw driver. In other embodiments, the tool is a custom tool. For example, the custom tool could have a hook or claw on a distal end that is configured to engage with the portion of the light fixture assembly 24.

Figure 5:
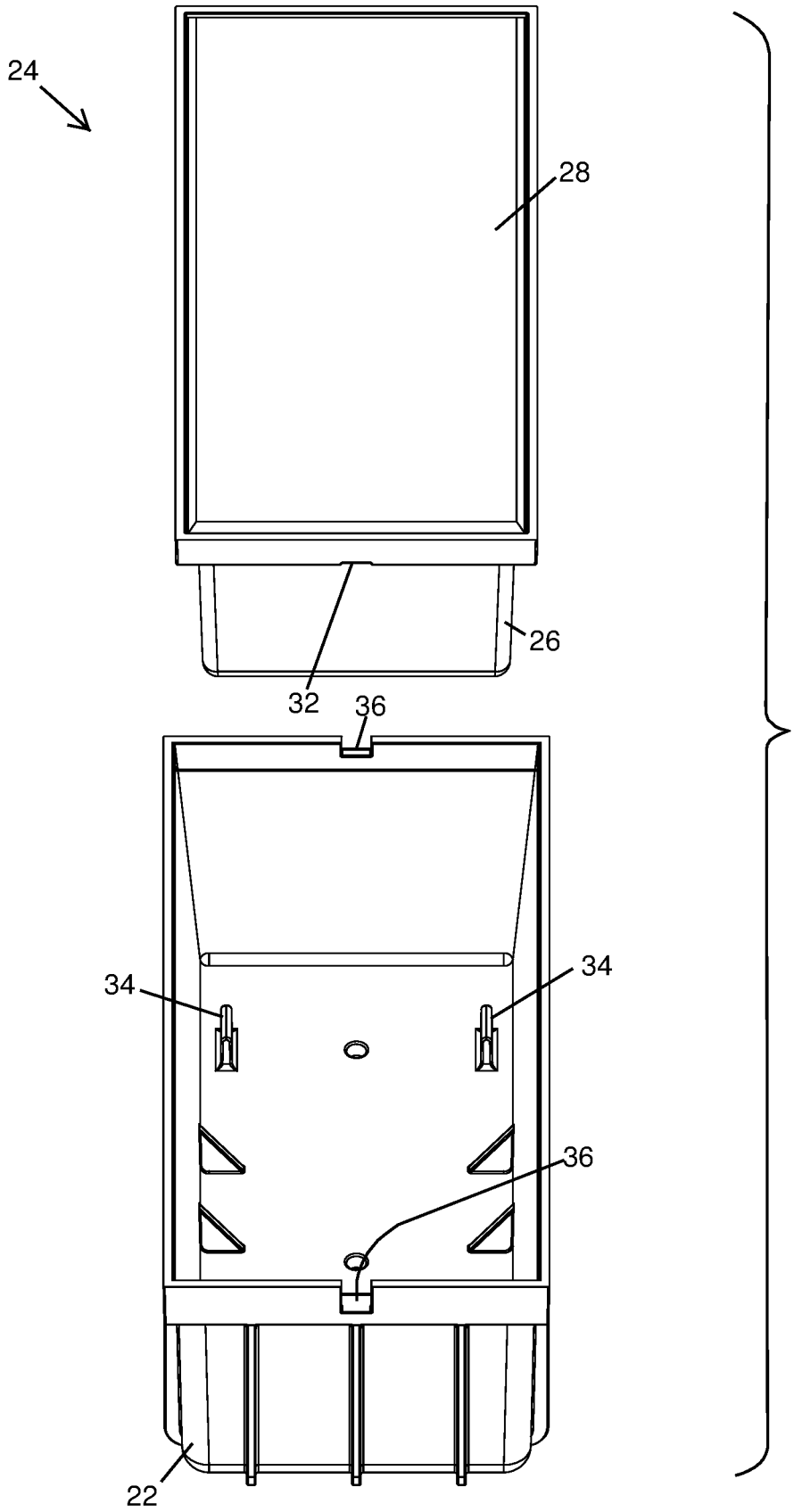
FIG. 5 is an exploded top perspective view of the light assembly of FIG. 1.

FIG. 5 is an exploded top perspective view of the light assembly 20 of FIG. 1. As is illustrated in FIG. 5 and in certain embodiments, the one or more coupling structures 34 of the sleeve 22 are disposed inside the sleeve 22. In certain embodiments, the one or more coupling structures 34 are disposed on the interior bottom of the sleeve 22. In certain embodiments, the one or more coupling structures 34 are disposed on a different surface than the interior bottom of the sleeve 22 as long as the surface is complementary with the surface of the housing 26 that includes the one or more engagement structures 30 or at least are in proximity to the one or more engagement structures 30 when the light fixture assembly 24 is disposed within at least a portion of the sleeve 22.

Figure 6:
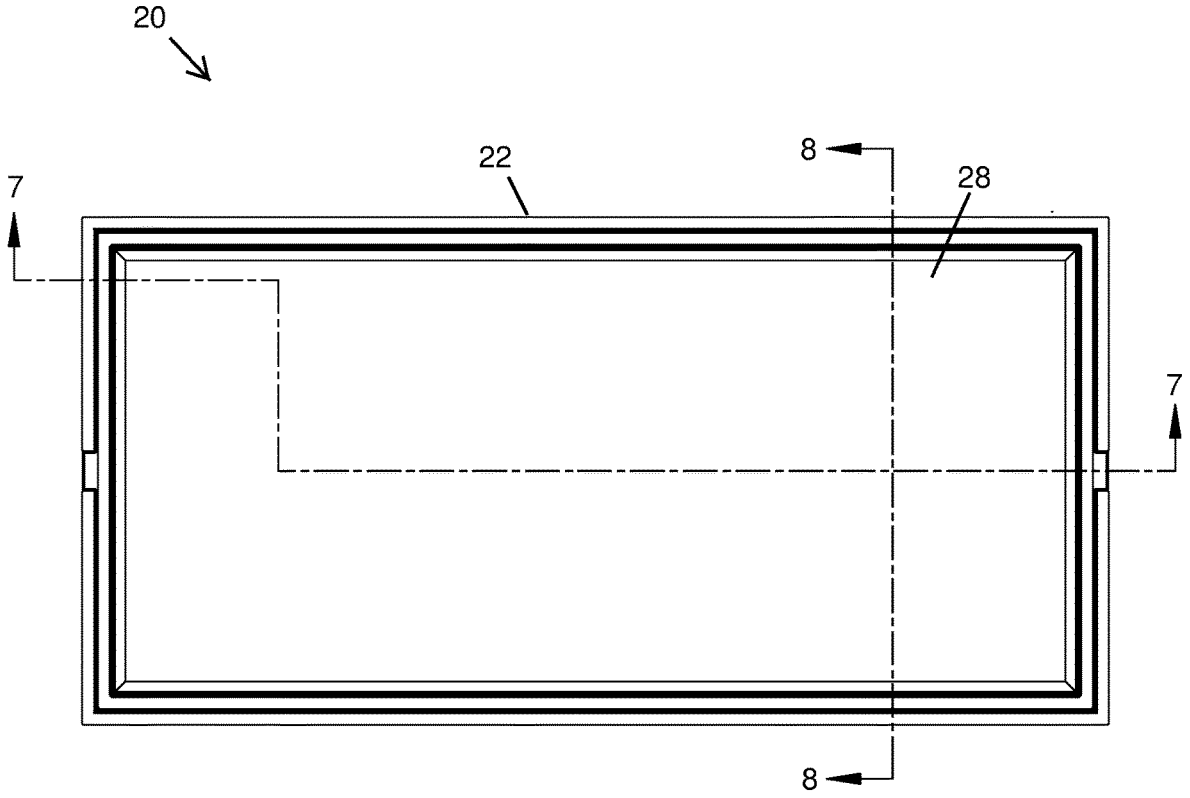
FIG. 6 is a top view of the light assembly of FIG. 1.
Figure 7:
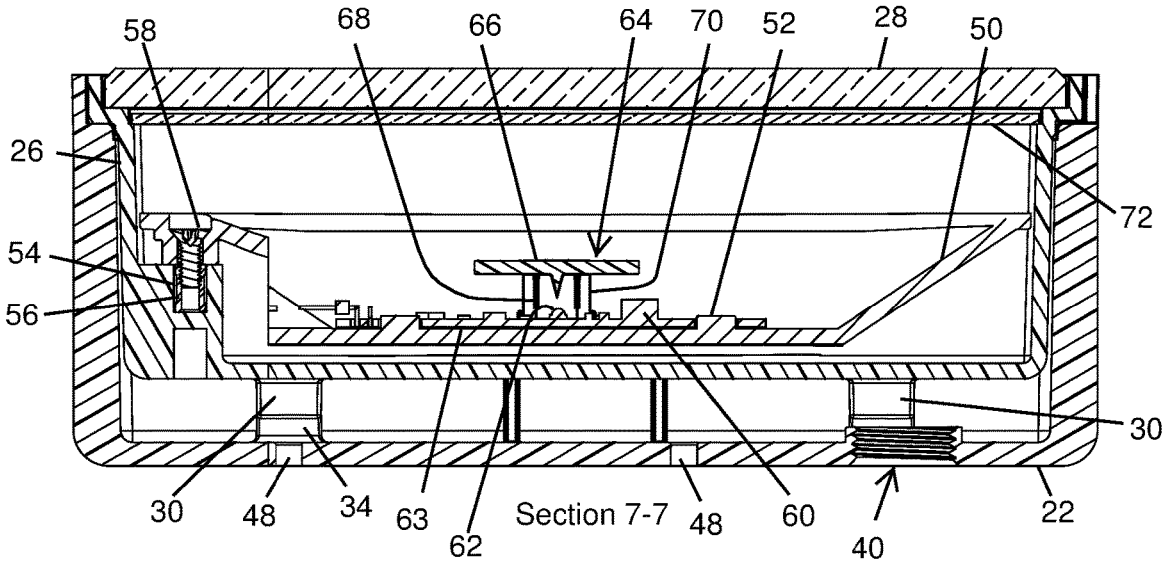
FIG. 7 is a cross-sectional view of the light assembly of FIG. 6 taken along line 7-7 as depicted in FIG. 6.
Figure 8:
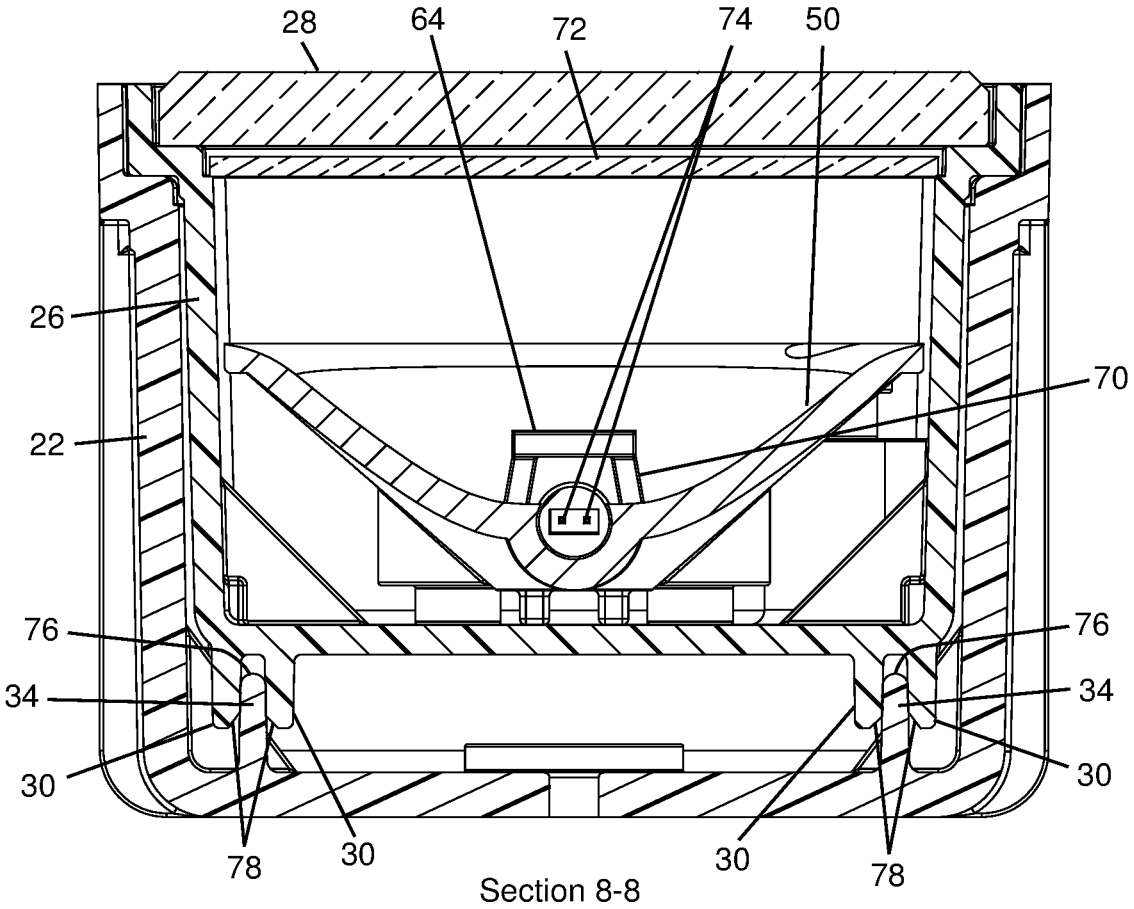
FIG. 8 is a cross-sectional view of the light assembly of FIG. 6 taken along line 8-8 as depicted in FIG. 6.

FIG. 6 is a top view of the light assembly 20 of FIG. 1. As is illustrated in FIG. 6, the light fixture assembly 24 is installed in the sleeve 22. FIG. 7 is a cross-sectional view of the light assembly 20 of FIG. 6 taken along line 7-7 as depicted in FIG. 6. FIG. 8 is a cross-sectional view of the light assembly 20 of FIG. 6 taken along line 8-8 as depicted in FIG. 6.

As shown in FIG. 7, one or more individual components of the light fixture assembly 24 can include a reflector 50. In certain embodiments, at least a portion of the reflector 50 is positioned below a circuit board 60. In certain embodiments, at least a portion of the reflector 50 is positioned to at least one side of the circuit board 60 and extends in a direction towards the lens 28. In certain embodiments, the reflector 50 can directly or indirectly intensify, distribute and/or otherwise focus light emitted from one or more light sources 62 on the circuit board 60. In certain embodiments, the reflector 50 comprises one or more nubs 52. The one or more nubs 52 are configured to position the circuit board 60 on the reflector 50 via one or more locating holes 86 (see FIG. 9). In this way, the circuit board 60 is positioned relative to the reflector 50.

In certain embodiments, the circuit board 60 can support the one or more light sources 62. The one or more light sources 62 can be one or more light emitting diodes (LEDs), incandescent bulbs, fluorescent bulbs, halogen bulbs, or high intensity discharge bulbs. In embodiments, the circuit board 60 is configured so that the one or more light sources 62 are one or more LEDs that emit a single color such as white, red, green, or blue. In other embodiments, the one or more LEDs emit multiple colors such as by employing an array of controlled RGB LEDs. The one or more light sources 62 can be positioned or otherwise configured to emit light in one or more directions.

In certain embodiments, the circuit board 60 includes a driver circuit for the one or more light sources 62. In certain embodiments, the circuit board 60 includes a temperature sensor. In certain embodiments, the circuit board 60 includes a microcontroller. For embodiments where the one or more light sources 62 are LEDs, the driver circuits for the LEDs can be disposed on the circuit board 60. While FIG. 7 illustrates a single LED and driver on a single circuit board 60, the disclosure is not so limited. For example, the light fixture assembly 24 can includes multiple LEDs, multiple drivers, and multiple circuit boards 60 positioned within the light fixture assembly 24.

In certain embodiments, the light fixture assembly 24 comprises one or more thermal pads 63. In certain embodiments, the one or more thermally conductive pads or thermal pads 63 are positioned between the circuit board 60 and the reflector 50. In certain embodiments, the one or more thermal pads 63 are configured to transfer heat from the circuit board 60 to the reflector 50. In certain embodiments, the thermal pads 63 are positioned to contact a portion of the housing 26 when the circuit board 60 is positioned by the one or more nubs 52 on the reflector 50. In certain embodiments, the one or more thermal pads 63 may act as heat sinks. In certain embodiments, the one or more thermal pads 63 may have increased heat conduction properties when compressed.

In certain embodiments, the reflector 50 can be formed of one or more plastics such as a molded plastic. In certain embodiments, the reflector 50 can be formed of one or more heat dissipating plastics. In certain embodiments, the reflector 50 can be formed of one or more metals. A metal reflector 50 can advantageously provide a heat sink for the one or more light sources 62. In certain embodiments, a plastic reflector 50 can advantageously provide a heat sink for the one or more light sources 62. In certain embodiments, the reflector 50 can be created with a 3D printer. In certain embodiments, the reflector 50 can be stamped from a sheet of metal. In certain embodiments, the reflector 50 is powder coated with a high gloss white.

In certain embodiments, the reflector 50 is releasably secured to the housing 26. For example, the reflector 50 can be press fit or snap fit to the housing 26. In certain embodiments, the reflector 50 can be loosely positioned within the housing 26. In certain embodiments, the reflector 50 can be secured within the housing 26. In certain embodiments, the reflector 50 can be snugly or closely fit in the housing 26.

In certain embodiments, the housing 26 further comprises one or more hubs 80 (see FIG. 9) configured to receive a screw 58 or other fastener to releasably secure the reflector 50 to the housing 26. In certain embodiments, each of the one or more hubs 80 includes a bore 54 having a threaded insert 56. Of course the threaded insert 56 is not necessary in that the screw 58 can be directly secured to the one or more hubs 80.

The threaded insert 56 can be formed of one or more plastics such as a molded plastic. In certain embodiments, the threaded insert 56 can be formed of one or more metals. In certain embodiments, the threaded insert 56 can be formed of cast aluminum. In certain embodiments, the threaded insert 56 can be formed of cast brass. The threaded insert 56 can be configured to engage threads of the screw 58. In certain embodiments, the screw 58 is threaded into the threaded insert 56 to secure the reflector 50 to the housing 26.

Another of the one or more individual components of the light fixture assembly 24 can include a deflector 64. In certain embodiments, the deflector 64 is supported by the reflector 50. In certain embodiments, the deflector 64 is positioned over the one or more light sources 62. In certain embodiments, the deflector 64 includes one or more legs 70. In certain embodiments, the one or more legs 70 of the deflector 64 are secured to the reflector 50 via one or more fasteners 90 such as screws (See FIG. 9). In certain embodiments, the circuit board 60 is positioned by the one or more nubs 52 and disposed between the one or more legs 70 of the deflector 64 and the reflector 50. In this way, the circuit board 60 and the one or more thermal pads 63 are held snuggly against the reflector 50.

Some of the one or more individual components of the light fixture assembly 24 can include a cover 66 and one or more windows 68. In certain embodiments, the cover 66 is disposed over an upper surface of the deflector 64. In certain embodiments, the one or more windows 68 are disposed on and span between the one or more legs 70 of the deflector 64 and on opposite sides of the deflector 68 below the cover 66. In this way, the deflector 64 is configured to preferentially direct light from the one or more light sources 62 through the one or more windows 68 and towards the reflector 50. An exemplary embodiment of the deflector 64 illustrated in FIG. 7 includes one or more slots 88 in the one or more legs 70 of the deflector 64 (See FIG. 9). In certain embodiments, the one or more windows 68 are disposed in the one or more slots 88. In certain embodiments, the cover 66 is configured to inhibit light from being transmitted up through the one or more slots 88 or edges of the one or more windows 68 of the deflector 64.

In certain embodiments, the one or more windows 68 can be plastic or glass. In certain embodiments, the one or more windows 68 can be transparent or substantially transparent. In certain embodiments, the one or more windows 68 can be frosted plastic. In certain embodiments, the one or more windows 68 may be tinted with a color. In certain embodiments, the one or more windows 68 may be tinted with a color to change the color temperature of the light emitting from the light fixture assembly 24.

As shown in FIG. 7, the one or more individual components of the light fixture assembly 24 can include a diffuser 72. The diffuser 72 can be positioned between the lens 28 and the circuit board 60. In certain embodiments, the diffuser 72 can direct light in one or more defined directions. In certain embodiments, the diffuser 72 can spread light in a more even distribution to an intended surface than the light fixture assembly 24 without the diffuser 72.

In certain embodiments, the diffuser 72 can be positioned, shaped, sized, or otherwise formed to enhance the quality of the light fixture assembly 24. In certain embodiments, the diffuser 72 can be loosely positioned within the housing 26. In certain embodiments, the diffuser 72 can be secured within the housing 26. In certain embodiments, the diffuser 72 can be secured within the housing 26 by a press fit or snap fit. In certain embodiments, the diffuser 72 can be snugly or closely fit to the housing 26. In certain embodiments, the diffuser 72 can be releasably secured to the housing 26 by a press fit or snap fit.

In certain embodiments, the diffuser 72 can be positioned to allow light from inside the light fixture assembly 24 to project in at least one direction exterior to the light fixture assembly 24. In certain embodiments, the diffuser 72 may be plastic or glass. In certain embodiments, the diffuser 72 can be transparent or substantially transparent. In certain embodiments, the diffuser 72 can be translucent or semi-transparent. In certain embodiments, the diffuser 72 can be frosted. In certain embodiments, the diffuser 72 may be tinted with a color. In certain embodiments, the diffuser 72 may be tinted with a color to change the color temperature of the light emitting from the light fixture assembly 24.

In certain embodiments, the diffuser 72 can include a textured surface. In certain embodiments, the diffuser 72 can include a surface textured or otherwise configured to disperse light in a more even distribution from the one or more light sources 62 towards the lens 28.

In an exemplary operation of the light fixture assembly 24, the one or more light sources 62 are illuminate when power is applied to the circuit board 60. In certain embodiments, a command signal is sent to the circuit board 60 to illuminate the light fixture assembly 24. The deflector 64 preferentially directs light from the one or more light sources 62 through the one or more windows 68 and towards the reflector 50. For a rectangular light fixture assembly 24 as is illustrated in FIG. 6, the deflector 64 preferentially directs light through the one or more windows 68 and towards a longer axis of the reflector 50. The translucent window material of the one or more windows 68 softens the concentrated spot of light from the one or more light sources 62, such as an LED. A smaller amount of light is transmitted through the one or more slots 88 holding the one or more windows 68 in place and towards the shorter axis of the reflector 50. The cover 66 and opaque surfaces of the one or more legs 70 prevent light from being transmitted in other undesirable areas.

The light that passes through the deflector 64 towards the reflector 50 is directed by the shape of the reflector 50 towards the diffuser 72. The diffuser 72 further softens any hot spots and transmits an even glow through the lens 28. The lens 28 protects the one or more light sources 62 as it is subjected to foot and mobile traffic, dirt, water, etc.

As is illustrated in FIG. 8, the light fixture assembly 24 further includes one or more contact pins 74. In certain embodiments, the light fixture assembly 24 can include two, three, four, or any other suitable number of contact pins 74. In certain embodiments, the one or more contact pins 74 can be disposed such that the one or more contact pins 74 electrically connect with a plug 84 on the wire 42. In certain embodiments, the one or more contact pins 74 are disposed on the circuit board 60. In certain embodiments, the one or more contact pins 74 extend from the circuit board 60 along a longitudinal axis. In certain embodiments, the one or more contact pins 74 are soldered to the circuit board 60. Electrically connecting the one or more contact pins 74 with the plug 84 during manufacture provides electrical continuity between the circuit board 60 and the wire 42.

As is further illustrated in FIG. 8 and in certain embodiments, the one or more engagement structures 30 of the housing 26 in a shape of legs are engaged with the one or more coupling structures 34 of the sleeve 22 in the shape of a tab. In this way, the one or more engagement structures 30 are press fit over the one or more coupling structures 34 when the light fixture assembly 24 is disposed within the sleeve 22. In certain embodiments, the light fixture assembly 24 is releasably secured to the one or more coupling structures 34 of the sleeve 22 via a snap fit or press fit. In certain embodiments, the one or more coupling structures 34 limit movement of the light fixture assembly 24 relative to the sleeve 22 so that the light fixture assembly 24 does not disengage from the sleeve 22 due to pedestrian traffic or other contact with the exposed portion of the light assembly 20 when installed in the hardscape. For example, in certain embodiments, the one or more coupling structures 34 prevent the light fixture assembly 24 from disengaging from the sleeve 22 and presenting a tripping hazard to pedestrian traffic.

As is illustrated in FIG. 8 and in certain embodiments, the one or more coupling structures 34 of the sleeve 22 and/or the one or more engagement structures 30 of the housing 26 are sized and shaped to complement each other and/or facilitate their assembly. For example, in certain embodiments the one or more coupling structures 34 of the sleeve 22 in the shape of the tab have a radius 76 at a distal end to facilitate alignment of the tab with the legs during assembly. Similarly and in certain embodiments, the one or more engagement structures 30 of the housing 26 in the shape of the legs have chamfers 78 at their distal ends to facilitate alignment of the legs with the tab during assembly. In certain embodiments, the legs can be radiused at their distal ends and/or the tab can be chamfered at its distal end to facilitate assembly.

Figure 9:
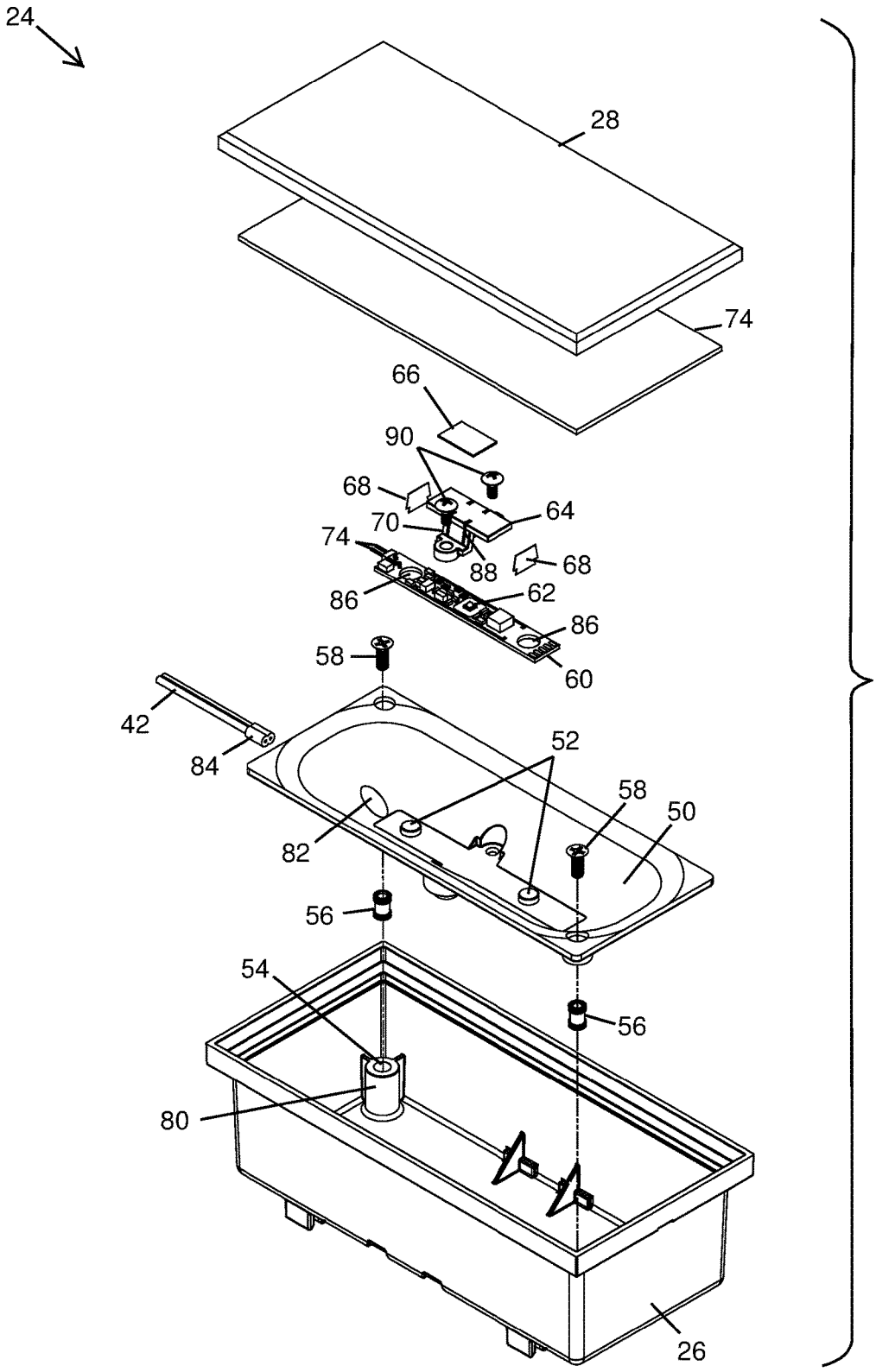
FIG. 9 is an exploded perspective view of the light fixture assembly of the light assembly of FIG. 1 showing a cover and one or more windows prior to their assembly with the deflector.
Figure 10:
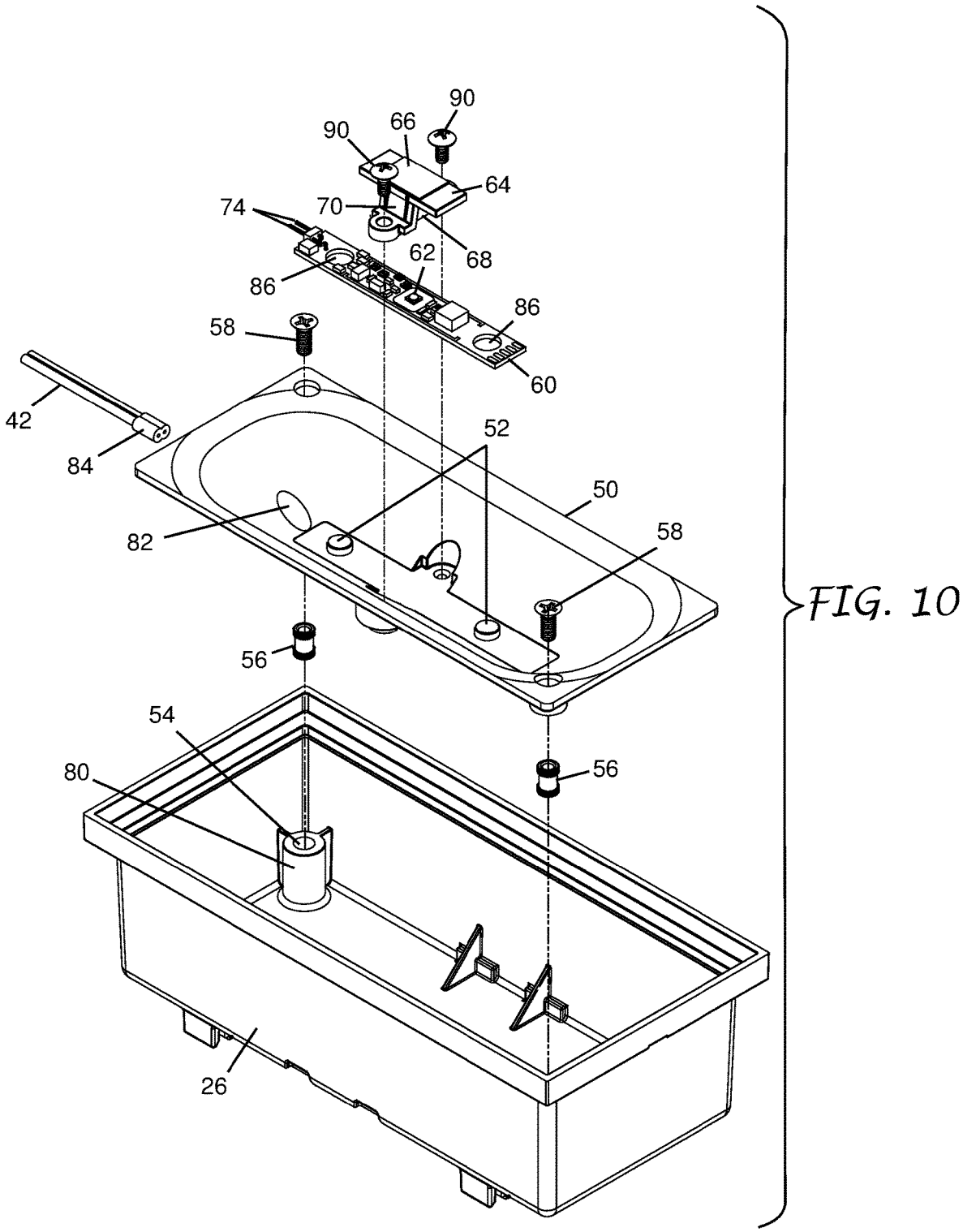
FIG. 10 is a partial view of the light fixture assembly shown in FIG. 9 without a lens and a diffuser as well as having the cover and the one or more windows assembled to the deflector.

The assembly of certain components of the light fixture assembly 24 will be described in connection with FIGS. 9 and 10. FIG. 9 is an exploded perspective view of the light fixture assembly 24 of the light assembly 20 of FIG. 1 showing the cover 66 and the one or more windows 68 prior to their assembly with the deflector 64. FIG. 10 is a partial view of the light fixture assembly 24 shown in FIG. 9 without the lens 28 and the diffuser 72 as well as showing the cover 66 and the one or more windows 68 assembled to the deflector 64. In certain embodiments, the one or more windows 68 are snapped into the one or more slots 88 during assembly. In certain embodiments, the cover 66 is placed over the top of the deflector 64 to prevent light from shining directly on the diffuser 72. The two fasteners 90 such as screws can be used to releasably attach the deflector 64 to the reflector 50.

In certain embodiments as is illustrated in FIGS. 9 and 10, the circuit board 60 includes the one or more light sources 62 and the driver circuitry for the one or more light sources 62. In certain embodiments, the circuit board 60 can receive a data encoded power signal. In certain embodiments, the one or more light sources 62 can be dimmable. In certain embodiments, the one or more light sources 62 can be color changing. In certain embodiments, the one or more light sources 62 can be operated by a switch, a remote control, or any other suitable controller. In some embodiments, the one or more light sources 62 can be operated by a lighting controller as disclosed in U.S. Pat. No. 9,295,170 issued Mar. 22, 2016, a circuit board and controller that can control at least one of dimming, zoning, and lighting as disclosed in U.S. Pat. No. 9,521,725 issued Dec. 13, 2016, and U.S. patent application publication No. 2017/0127493 filed Jan. 12, 2017. All of which list Woytowitz as an inventor and are assigned to Hunter Industries, Inc., the assignee of the current application.

As is illustrated in FIGS. 9 and 10 and in certain embodiments, the locating holes 86 loosely fit around the one or more nubs 52 formed in the reflector 50. When assembled, the circuit board 60 is confined between the reflector 50 and the deflector 64.

The one or more pins 74 are configured to connect to the plug 84 formed on the end of the wire 42. In certain embodiments, the wire 42 is connected directly to the circuit board 60 without the use of the one or more pins 74 and the plug 84. Power is supplied to the one or more pins 74. In certain embodiments, signals in the form of the communications and/or control commands are supplied through the wire 42 from or to a programmable controller.

As is illustrated in FIGS. 9 and 10, and in certain embodiments, each of the one or more hubs 80 in the housing 26 receives the screw 58 or other fastener to releasably secure the reflector 50 to the housing 26. In certain embodiments, the reflector 50 may include a hole 82 configured to allow the wire 42 and or plug 82 to pass therethrough.

Figure 11:
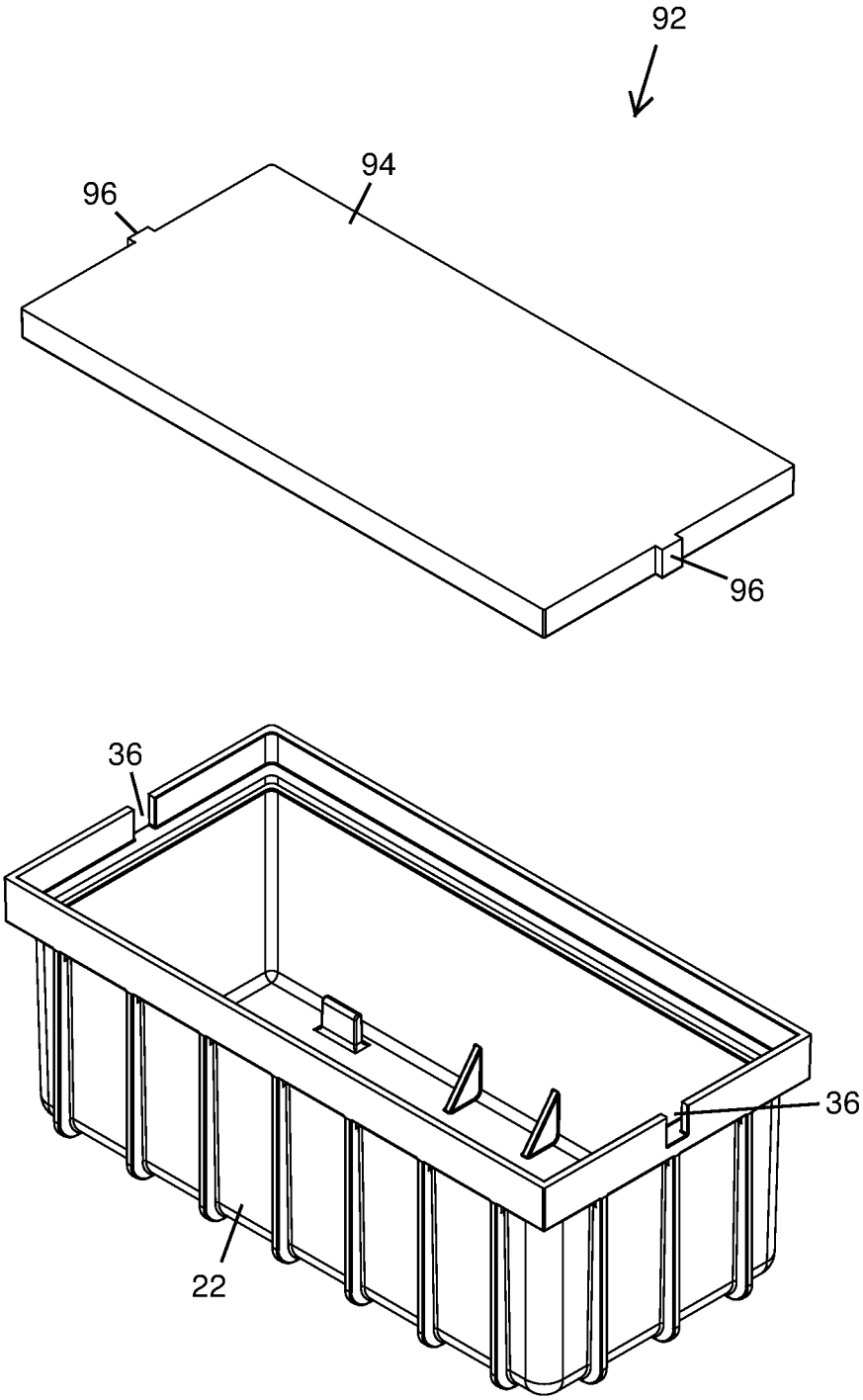
FIG. 11 is similar to FIG. 2 except that the light fixture assembly of the light assembly is temporarily removed from the sleeve and replaced with an installation plate to form a dummy light for use during installation in a pathway or other hardscape area.

FIG. 11 is similar to FIG. 2 except that the light fixture assembly 24 of the light assembly 20 is temporarily removed from the sleeve 22 and replaced with an installation plate 92 to form a dummy light 92 for use during installation in a pathway or other hardscape area. In certain embodiments, the installation plate 94 is sized and shaped to fit within the sleeve 22 in place of the light fixture assembly 24. In certain embodiments, the installation plate 94 is made of any durable material such as plastic or metal. In certain embodiments, the installation plate 94 includes one or more protrusions 96 configured to fit within the one or more notches 36 in the sleeve 22. The one or more protrusions 96 are easily accessible for removing the installation plate 94 from the sleeve 22.

In certain embodiments, the dummy light 92 comprises the sleeve 22 and the installation plate 94. By removing the light fixture assembly 24 and forming the dummy light 92, the dummy light 92 can then be used in lieu of the light assembly 20 during the installing of the pathway to avoid damaging the lens and other components of the light assembly 20 during the installation.

In certain embodiments, when installing a paver pathway or other hardscape area such as a patio, the process begins with setting the pavers in place. In the desired location for the light assembly 20 within the pathway and in lieu of placing a paver, the dummy light 92 is installed. When the pavers and the dummy light 92 are positioned correctly, sand is spread over the entire surface of the pathway. A vibrating plate can then be used to level the entire surface and vibrate the sand to fall between the pavers including the dummy light 92.

Once leveled, the user removes the installations plate 94. In certain embodiments, the installation plate does not include the protrusions 96 and the user removes the installation plate 94 using a tool in a similar fashion to how they remove the light fixture assembly 24. In certain embodiments where the installation plate 94 does include the one or more protrusions 96, the user grasps the one or more protrusions 96 of the installation plate 94 to remove the installation plate 94 from the sleeve 22. In some instances, the user may utilize a tool, such as a screw driver, to pry up the one or more protrusions 96. The wire 42 coming from the light fixture assembly 24 is then electrically connected to the wire 44 via the one or more connectors 46. The wired light fixture assembly 24 is then pushed into the sleeve 22. As the light fixture assembly 24 is pushed into the sleeve 22, the one or more engagement structures 30 of the housing 26 engage with the one or more coupling structures 34 of the sleeve 22. In this way, the one or more engagement structures 30 are press fit over the one or more coupling structures 34 when the light fixture assembly 24 is disposed within the sleeve 22. In certain embodiments, the one or more coupling structures 34 limit movement of the light fixture assembly 24 relative to the sleeve 22 so that the light fixture assembly 24 does not disengage from the sleeve 22 due to pedestrian traffic or other contact with the exposed portion of the light assembly 20 when installed in the pathway or other hardscape.

If the installation process outlined above were employed with the light assembly 20 and not the dummy light 92, the light assembly 20 may be destroyed or at least its lens 28 would be severely damaged. The installation process provides a way for the sleeve 22 and the pavers to all be properly leveled and packed during installation. Further, the installation plate 92 is disposable, so any damage done to the installation plate 92 is inconsequential.

Figure 12:
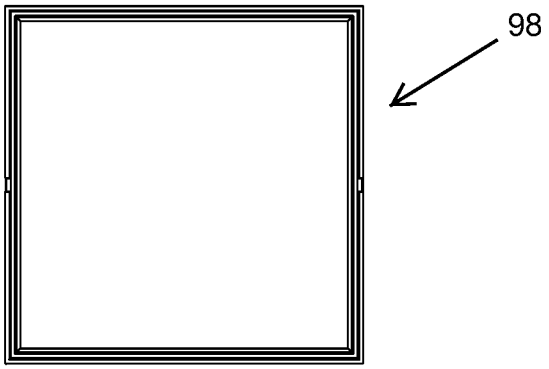
FIGS. 12 through 14 are similar to FIG. 6 except that instead of the light assembly having a shape of a rectangle, the light assembly has various other shapes including, for example, square, octagon, and hexagon.
Figure 13:
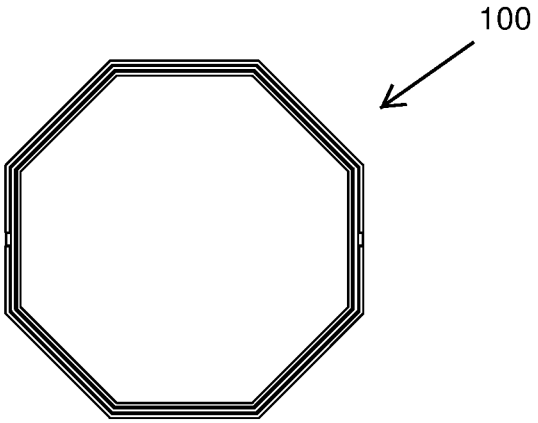
Figure 14:
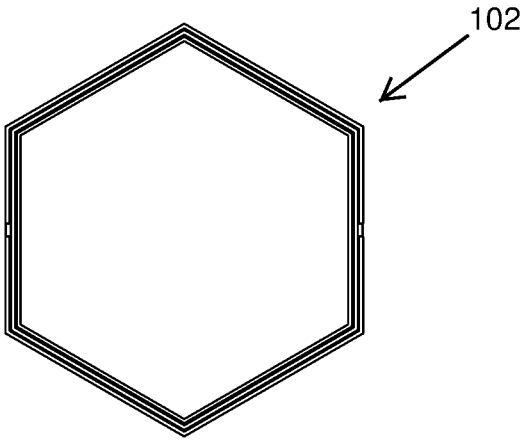

FIGS. 12 through 14 are similar to FIG. 6 except that instead of the light assembly 20 having a shape of a rectangle, the light assembly 20 has various other shapes including, for example, square 98, octagon 100, and hexagon 102. Of course the shape of the light assembly 20 is not limited to the illustrated shapes and could be any other shape, for example, round and oblong.

While the above detailed description has shown, described, and pointed out novel features of the development as applied to various embodiments, it will be understood that various omissions, substitutions, and changes in the form and details of the devices illustrated may be made by those skilled in the art without departing from the spirit of the development. As will be recognized, the present development may be embodied within a form that does not provide all of the features and benefits set forth herein, as some features may be used or practiced separately from others. All changes which come within the meaning and range of equivalency of the claims are to be embraced within their scope.

The foregoing description details certain embodiments of the systems, devices, and methods disclosed herein. It will be appreciated, however, that no matter how detailed the foregoing appears in text, the systems, devices, and methods may be practiced in many ways. As is also stated above, it should be noted that the use of particular terminology when describing certain features or aspects of the invention should not be taken to imply that the terminology is being redefined herein to be restricted to including any specific characteristics of the features or aspects of the technology with which that terminology is associated.

It will be appreciated by those skilled in the art that various modifications and changes may be made without departing from the scope of the described technology. Such modifications and changes are intended to fall within the scope of the embodiments. It will also be appreciated by those of skill in the art that parts included in one embodiment are interchangeable with other embodiments; one or more parts from a depicted embodiment may be included with other depicted embodiments in any combination. For example, any of the various components described herein and/or depicted in the Figures may be combined, interchanged or excluded from other embodiments.

With respect to the use of substantially any plural and/or singular terms herein, those having skill in the art may translate from the plural to the singular and/or from the singular to the plural as is appropriate to the context and/or application. The various singular/plural permutations may be expressly set forth herein for sake of clarity.

It will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The term "comprising" as used herein is synonymous with "including," "containing," or "characterized by," and is inclusive or open-ended and does not exclude additional, unrecited elements or method steps.

The above description discloses several methods of manufacture and materials of the present development. This development is susceptible to modifications in the methods and materials, as well as alterations in the fabrication methods and equipment. Such modifications will become apparent to those skilled in the art from a consideration of this disclosure or practice of the development disclosed herein. Consequently, it is not intended that this development be limited to the specific embodiments disclosed herein, but that it cover all modifications and alternatives coming within the true scope and spirit of the development as embodied in the attached claims.

While the above detailed description has shown, described, and pointed out novel features of the improvements as applied to various embodiments, it will be understood that various omissions, substitutions, and changes in the form and details of the device or process illustrated may be made by those skilled in the art without departing from the spirit of the invention. As will be recognized, the present invention may be embodied within a form that does not provide all of the features and benefits set forth herein, as some features may be used or practiced separately from others. The scope of the invention is indicated by the appended claims rather than by the foregoing description. All changes which come within the meaning and range of equivalency of the claims are to be embraced within their scope.

What is claimed is:

1. An outdoor light assembly configured to be disposed in a pathway or other hardscape area, the light assembly comprising:

a sleeve forming a receptacle having one or more coupling structures disposed in the receptacle; and a user replaceable light fixture assembly being sized and shaped to transition between a secured position and an unsecured position relative to the receptacle, the user replaceable light fixture assembly having one or more engagement structures and a power transfer element, the one or more engagement structures engage with the one or more coupling structures of the sleeve when the user replaceable light fixture assembly is pressed into the secured position, the power transfer element being configured to electrically connect with a source of electric power through the sleeve at least when the user replaceable light fixture assembly is in the unsecured position, wherein the one or more engagement structures engage with the one or more coupling structures in a press fit manner.

2. The outdoor light assembly of claim 1, wherein the power transfer element comprises a wire.

3. The outdoor light assembly of claim 2, wherein the power transfer element further comprises an electrical contact configured to electrically connect the wire to the user replaceable light fixture assembly.

4. The outdoor light assembly of claim 2, wherein the sleeve comprises a passage, and wherein the wire is configured to pass through the passage and electrically connect with the source of electric power.

5. The outdoor light assembly of claim 2, wherein the sleeve comprises a passage, and wherein the wire is configured to couple to a proximal end of a power wire at a location within the sleeve, the power wire extending from the proximal end and passing through the passage to electrically connect with the source of electric power.

6. The outdoor light assembly of claim 1, wherein the user replaceable light fixture assembly comprises a housing and a lens, the lens being sized and shaped to cover at least an interior portion of the receptacle when the user replaceable light fixture assembly is in the secured position.

7. The outdoor light assembly of claim 6, wherein the sleeve further comprises a notch, and wherein the housing comprises a flange, at least a portion of the flange being accessible through the notch.

8. The outdoor light assembly of claim 6, wherein the sleeve further comprises a notch, and wherein the housing comprises a recess, at least a portion of the recess aligning with the notch when the user replaceable light fixture assembly is in the secured position.

9. The outdoor light assembly of claim 6, wherein the user replaceable light fixture assembly further comprises a circuit board supporting one or more light emitting diodes, the circuit board being electrically coupled to the wire, the one or more light emitting diodes being arranged relative to the circuit board to emit light in a first direction towards the lens when the user replaceable light fixture assembly is in the secured position.

10. The outdoor light assembly of claim 9, wherein the user replaceable light fixture assembly further comprises a deflector disposed so as to deflect the emitted light travelling in the first direction to travel in a second direction, the second direction being generally perpendicular to the first direction.

11. The outdoor light assembly of claim 1, wherein the one or more coupling structures are complementary to the one or more engagement structures so as to inhibit, but not prevent, removal of the user replaceable light fixture assembly from the sleeve when the user replaceable light fixture assembly is in the secured position.

12. The outdoor light assembly of claim 1, wherein the one or more engagement structures are configured in a shape of legs.

13. The outdoor light assembly of claim 12, wherein the one or more coupling structures are configured in a shape of a tab, the tab being sized and shaped to engage with the legs.

14. The outdoor light assembly of claim 1, wherein the one or more engagement structures are sized and shaped to press fit over the one or more coupling structures when the user replaceable light fixture assembly is in the secured position.

15. The outdoor light assembly of claim 1, wherein the user replaceable light fixture assembly is configured to transition from the unsecured position to the secured position without the use of tools.

16. The outdoor light assembly of claim 1, wherein the one or more coupling structures are disposed on an interior bottom surface of the receptacle.

17. An outdoor light assembly configured to be disposed in a pathway or other hardscape area, the light assembly comprising:

a sleeve forming a receptacle having one or more coupling structures disposed in the receptacle; and a user replaceable light fixture assembly being sized and shaped to transition between a secured position and an unsecured position relative to the receptacle, the user replaceable light fixture assembly having one or more engagement structures that are complementary to the one or more coupling structures so as to inhibit, but not prevent, removal of the user replaceable light fixture assembly from the sleeve when the user replaceable light fixture assembly is in the secured position, wherein the one or more engagement structures engage with the one or more coupling structures in a press fit manner when in the secured position.

18. The outdoor light assembly of claim 17, wherein the user replaceable light fixture assembly comprises a housing and a lens, the lens being sized and shaped to cover the receptacle when the user replaceable light fixture assembly is in the secured position.

19. The outdoor light assembly of claim 18, wherein the sleeve further comprises a notch sized and shaped to receive a tool.

20. The outdoor light assembly of claim 17, wherein the user replaceable light fixture assembly further comprises a circuit board supporting one or more light emitting diodes, the one or more light emitting diodes being arranged relative to the circuit board to emit light in a first direction when the user replaceable light fixture assembly is in the secured position.

21. The outdoor light assembly of claim 20, wherein the user replaceable light fixture assembly further comprises a deflector disposed so as to deflect the emitted light travelling in the first direction to travel in a second direction, the second direction being generally perpendicular to the first direction.

22. The outdoor light assembly of claim 17, wherein the one or more coupling structures are disposed on an interior bottom surface of the receptacle.

* * * * *